US010184724B2

(12) United States Patent
Anping et al.

(10) Patent No.: US 10,184,724 B2
(45) Date of Patent: Jan. 22, 2019

(54) METHOD AND APPARATUS FOR LONG FURNACE SUBLIMATION TRANSFER

(71) Applicant: Photo U.S.A. Corporation, Fremont, CA (US)

(72) Inventors: Peng Anping, Fremont, CA (US); Wang Pengyu, Beijing (CN)

(73) Assignee: Photo U.S.A. Corp., Fremont, CA (US)

( * ) Notice: Subject to any disclaimer, the term of this patent is extended or adjusted under 35 U.S.C. 154(b) by 0 days.

(21) Appl. No.: 15/362,630

(22) Filed: Nov. 28, 2016

(65) Prior Publication Data

US 2017/0146296 A1 May 25, 2017

Related U.S. Application Data

(60) Provisional application No. 62/364,254, filed on Jul. 19, 2016.

(51) Int. Cl.

| | |
|---|---|
| ***F27B 9/24*** | (2006.01) |
| ***F27D 3/12*** | (2006.01) |
| *F27D 3/00* | (2006.01) |
| *F27D 7/06* | (2006.01) |

(52) U.S. Cl.

CPC ..... *F27B 9/243* (2013.01); *F27D 3/12* (2013.01); *F27D 2003/0063* (2013.01); *F27D 2007/066* (2013.01)

(58) Field of Classification Search

CPC ..... B29C 65/56; B29C 65/72; B65C 9/06; B32B 38/14; B32B 37/02; B32B 37/14

See application file for complete search history.

(56) References Cited

U.S. PATENT DOCUMENTS

| | | | | |
|---|---|---|---|---|
| 4,662,966 | A * | 5/1987 | Sumi | B41F 16/00 101/474 |
| 5,308,426 | A | 5/1994 | Claveau | |
| 5,899,687 | A * | 5/1999 | Yu | B23K 3/0676 432/121 |
| 6,136,126 | A | 10/2000 | Fenzi | |
| 6,148,721 | A | 11/2000 | Hellmeier et al. | |
| 6,481,999 | B2 * | 11/2002 | Knost | A21B 1/26 126/21 A |

(Continued)

FOREIGN PATENT DOCUMENTS

| | | |
|---|---|---|
| CA | 2039054 | 10/1991 |
| FR | 2203321 | 5/1974 |

*Primary Examiner* — Gregory A Wilson

(74) *Attorney, Agent, or Firm* — Stetina Brunda Garred & Brucker; Lowell Anderson

(57) ABSTRACT

A sublimation furnace has a first endless conveyor belt extending along a first axis through the furnace, with a chamber extending above and along that first conveyor belt. Vacuum trays placed on the first belt have products abutting sublimation images to be transferred to the product as the trays pass through the furnace. The furnace has a first sidewall with a slot extending along the sidewall and along the first conveyor belt. A second endless conveyor belt extends along but offset from the first axis. A plurality of vacuum pumps are connected to the second conveyor belt and move with that belt, with each pump connected by a hose passing through the slot during use of the furnace to a different vacuum tray on the first conveyor in order to evacuate the vacuum trays and press the images against the product for sublimation transfer.

20 Claims, 6 Drawing Sheets

(56) References Cited

U.S. PATENT DOCUMENTS

| | | | | |
|---|---|---|---|---|
| 6,998,005 | B2 | 2/2006 | Magee et al. | |
| 7,077,926 | B2 | 7/2006 | Goffi et al. | |
| 7,137,426 | B2 | 11/2006 | Neri et al. | |
| 7,810,538 | B2 * | 10/2010 | Magee | B41M 5/0256 156/498 |
| 8,011,922 | B2 | 9/2011 | Checcucci | |
| 8,562,777 | B2 | 10/2013 | Drake | |
| 8,726,964 | B2 * | 5/2014 | Fenzi | B41F 16/00 156/285 |
| 9,311,831 | B2 | 4/2016 | Henshue et al. | |
| 2016/0290718 | A1 * | 10/2016 | Ye | F27B 9/042 |

* cited by examiner 80
66b
66b
79
78
20
76
22
70
74
70
18
66a
64
66a
28

METHOD AND APPARATUS FOR LONG FURNACE SUBLIMATION TRANSFER

CROSS-REFERENCE TO RELATED APPLICATIONS

The application claims the benefit under 35 U.S.C. § 119(e) to Provisional Patent Application No. 62/364,254 filed Jul. 19, 2016, the entire contents of which are incorporated herein by reference.

BACKGROUND

The present invention relates to method and apparatus for sublimation transfer using a long, tunnel furnace.

Sublimation transfer requires pressing a sublimation transfer image against a surface while heating the surface and image to a temperature high enough to cause the sublimation transfer image to sublimate and transfer to the surface. One approach to achieve this sublimation transfer is to have pressing devices shaped to conform to the product shape press the sublimation transfer image against the product while heating the product and image. Arrangements for transferring images to a coffee mug are described U.S. Pat. No. 5,755,921 to Christensen and U.S. Pat. No. 5,944,931 to Cranford. These patents place the assembled pressing device, image and product in an oven and remove them after each sublimation transfer occurs. These one-at-a-time approaches are inefficient for handling large numbers of products because the time to load, unload, heat and cool each product is extensive and hence the accompanying cost is high. There is thus a need for an improved sublimation transfer process and apparatus.

Another approach to achieve this transfer is have sublimation transfer images held against the product surface by stretching elastomeric sheets to press the images against the product surface. The assembly is heated in a furnace, causing the images to transfer to the product surface under pressure provided by stretching the elastomeric sheets around the products to cause sufficient pressure for sublimation transfer. The elastomeric sheets and transfer process are as generally described in U.S. Pat. No. 8,002,931 to Wang et al. Sublimation transfer has used a mesh belt conveyor to move products along a long tunnel. These assemblies may be placed in the bottom of an oven or furnace, or they may be placed on an endless, moving conveyor belt that passes through a furnace to achieve the heating and sublimation transfer. But the wrapping of stretched material does not conform to the configuration of rapidly changing surfaces and each product is individually wrapped. This approach is thus inefficient for handling large numbers of products because the time to load, unload, heat and cool each product is extensive and hence the accompanying cost is high. There is thus a need for an improved sublimation transfer process and apparatus.

Vacuum has been used to draw flexible membranes against a surface in order to apply the pressure for sublimation transfer, with U.S. Pat. Nos. 6,814,831 and 7,810,583 describing such systems. But the vacuum systems use single trays that are immovable or reciprocate into or out of a heating chamber, limiting the use of the apparatus and quantities of resulting imaged products. There thus remains a need for an improved method and apparatus to efficiently apply sublimation images to products.

BRIEF SUMMARY

In one embodiment, the present invention provides a sublimation furnace with a first endless conveyor belt extending along a first axis through the furnace. The furnace has a chamber extending above and along that first conveyor belt. Vacuum trays are placed on the first belt where the trays have products abutting sublimation images to be transferred to the product as the trays pass through the furnace. The furnace has a first sidewall with a slot extending along the sidewall and along the first conveyor belt. A second endless conveyor belt extends along but offset from the first axis. A plurality of vacuum pumps are each connected to the second conveyor belt and move with that belt. Each vacuum pump is connected by a hose passing through the slot during use of the furnace to a different vacuum tray on the first conveyor in order to evacuate the vacuum trays and press the images against the product for sublimation transfer.

In a further embodiment, there is advantageously provided a furnace having a conveyor belt for heating a product on the belt as the product moves through the furnace on the belt. The furnace includes a first endless conveyor belt extending along a first axis. The furnace has a chamber extending above and along a first length of the first conveyor belt. The furnace chamber has an inlet end and an outlet end through which the first conveyor belt passes. The furnace also has heaters and a first side wall extending along the first length of the first conveyor. A slot extends through the first side wall and further extends along the first conveyor. The furnace has a second endless conveyor belt extending along but offset from the first axis. The furnace has a plurality of vacuum pumps, each connected to the second conveyor belt and moving with that second conveyor belt. Each vacuum pump has a vacuum hose connected to it with the hose passing through the slot during use of the furnace and pump.

In further variations of this further embodiment, the furnace has a power strip extending along a length of the second conveyor belt. The power strip has a first elongated electrically conductive strip carrying electrical current along that length of the second conveyor belt during use. Each of the plurality of vacuum pumps has an electrical connection resiliently urged into electrical contact with that first conductive strip during use. A vacuum housing may extend along and enclose the second conveyor belt and the power strip. The first and second conveyor belts may be driven by a common drive shaft or by separate shafts rotating about a common axis.

In further variations, the slot may have a longitudinal length with two opposing sides and a vertical height between those two sides, and may have at least one flexible strip of material extending from one side of the slot toward the other side of the slot. The material advantageously has sufficient flexibility so each hose may push the material aside as the hose moves along the length of the slot. The flexible strip of material may include first and second strips of material each extending from a different side of the slot and extending toward the other strip of material to block the slot.

In further variations of this further embodiment, a plurality of vacuum trays are provided, each in fluid communication with a different one of the vacuum pumps through the hose associated with each vacuum pump. Each hose advantageously has a quick release coupling to releasably disconnect the hose from one of the vacuum pump or tray. The vacuum tray may advantageously include an enclosure with a bottom and sidewalls, a perforated support plate, a mounting boss, a product on that boss, a sublimation transfer image abutting the product, a flexible sealing sheet overlapping the product and image and at least a portion of the support plate, and a frame configured to hold the sealing sheet against the support plate.

In still further variations, a power strip extends along a length of the second conveyor belt. The power strip advantageously has a first elongated electrically conductive strip carrying electrical current along that length of the second conveyor belt during use. Each vacuum pump advantageously has a resilient electrical connection contacting the power strip and that first conductive strip during use. A plurality of the vacuum trays are each placed in fluid communication with a different one of the vacuum pumps through the hose associated with that different one of the vacuum pumps, with each hose having a quick release coupling to releasably connect the hose from one of the vacuum pump or tray.

There is also provided a method of sublimation transfer using a vacuum tray having a sublimation transfer image and product which are located between a sealing sheet and a bottom of the tray. The method placing a plurality of the vacuum trays on a first endless conveyor belt moving through a heated furnace. The furnace has an inlet end and an outlet end. Each vacuum tray has a separate fluid connection located to evacuate air from between the sealing sheet and tray bottom, with the tray placing step occurring at the inlet end of the furnace. The method includes placing a separate vacuum pump in fluid communication with the separate fluid connection of a different one of the plurality of vacuum trays. Each of the separate vacuum pumps is connected to and moves with a second endless conveyor belt moving parallel to the first conveyor belt. The method may further include evacuating air from between the sealing sheet and the tray bottom of each tray and pressing the sublimation transfer image against the product with sufficient force to achieve sublimation transfer. The method may also include heating the sublimation transfer image and product to a sublimation transfer temperature for a time sufficient to transfer the image to the product. shutting off the vacuum pump and then releasing the vacuum from the space between the sealing sheet and bottom of the tray. The method may further include removing the vacuum pump from fluid communication with the tray to which the vacuum pump was connected and removing the tray from the first conveyor belt at the outlet end of the furnace.

In further variations, the step of evacuating air may further include activating each vacuum pump at a first predetermined location of the vacuum pump along a length of the second conveyor. The step of shutting off the vacuum pump may include shutting off each vacuum pump at a second predetermined location of the vacuum pump along a length of the second conveyor. The step of placing a separate vacuum pump in fluid communication with the separate fluid connection of a different one of the plurality of vacuum trays advantageously uses a hose for the fluid communication and may also include passing that hose through a slot in the furnace and moving that hose along a length of the slot. The step of placing a separate vacuum pump in fluid communication with the separate fluid connection of a different one of the plurality of vacuum trays may also use a hose with a quick disconnect coupling for the fluid communication. The step of removing the fluid connection between each of the plurality of trays and the vacuum pump to which the tray was connected advantageously includes uses a quick disconnect coupling to disconnect a hose from the vacuum pump from the different vacuum trays In still further variations, the step of evacuating air from between the sealing sheet and the tray bottom of each tray advantageously includes activating the vacuum pump when the tray is at a first predetermined location of the first conveyor belt relative to the furnace. The step of activating the vacuum pump may include placing the vacuum pump in electrical contact with a power strip extending along a length of the second conveyor belt to place the vacuum pump in electrical communication with a power source. The step of evacuating air from between the sealing sheet and the tray bottom of each tray may include activating the vacuum pump before the tray has entered an actively heated portion of the furnace. The step of shutting off the vacuum pump may include deactivating the vacuum pump when the tray is at a second predetermined location of the first conveyor belt relative to the furnace, with the second predetermined distance being closer to the outlet end of the furnace than the first second predetermined distance. The step of shutting off the vacuum pump may include disconnecting the vacuum pump from electrical contact with the power strip.

BRIEF DESCRIPTION OF THE DRAWINGS

These and other advantages and features of the invention will be better appreciated in view of the following drawings and descriptions in which like numbers refer to like parts throughout, and in which.

DETAILED DESCRIPTION

Figure 1:
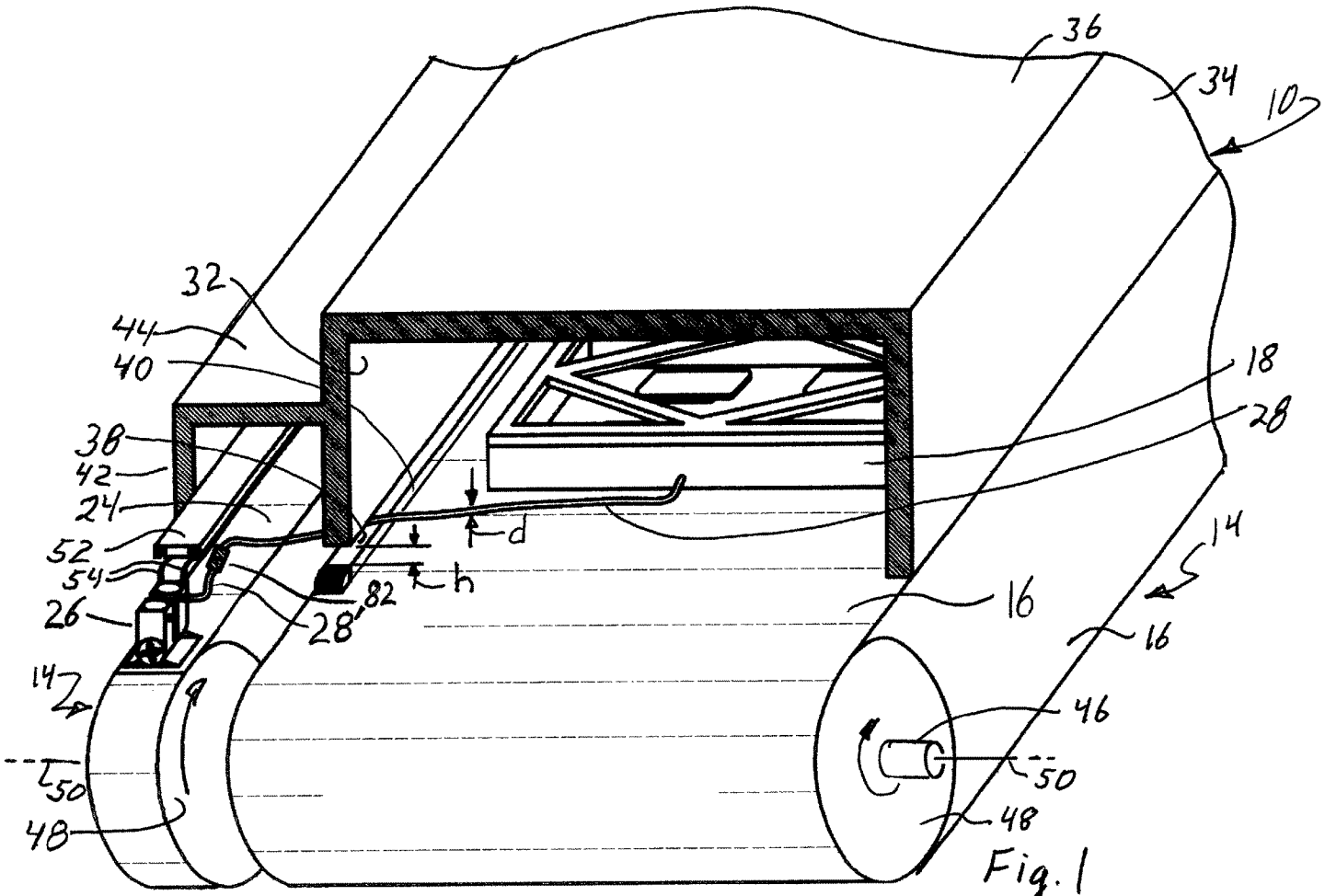
FIG. 1 is a partial perspective view of an elongated heating chamber, conveying mechanism and vacuum tray.

Referring to FIGS. 1-5, an elongated heating chamber 10 is provided having one or more heaters 12 (FIG. 3) with a conveyor mechanism 14 having a first conveyor belt 16 passing along the length of the chamber to carry a vacuum tray 18 through the heating chamber to place sublimation dye transfer images 20 (FIGS. 4-5) on products 22 (FIGS. 4-5) as they pass through the heating chamber 10. The conveyor mechanism preferably has a second conveyor belt 24 to which are fastened a plurality of vacuum pumps 26 each having a hose 28 releasably connected to and in fluid communication with an associated tray 18 to provide vacuum which in turn exerts a negative pressure pressing the dye transfer images 20 against the products 22 during sublimation transfer. As used herein, the relative directions up and down, upper and lower, top and bottom refer to the relative directions of gravity, so down is toward the earth and up is away from the earth.

The heating chamber 10 preferably has insulated walls, with FIG. 1 showing first and second opposing sidewalls 32, 34, respectively and a top 36 connecting the upper edges of sidewalls 32, 34 to form an inverted U-shaped chamber. The heating chamber 10 may have a bottom enclosing the conveying mechanism 14 and the return or the belt 16, but is depicted as having the first conveyor belt 16 form a bottom of the heating chamber. The first heating chamber sidewall 32 has a slot 38 extending along a length of the sidewall 32 and opening onto ends of the sidewall and chamber 10. The hose 28 passes along the length of the slot 38 as the first conveyor belt 16 moves vacuum tray 18 along a length of the elongated heating chamber. The heating chamber 10 is preferably insulated to reduce heat loss and reduce the energy needed to maintain the desired heating temperature in the actively heated portion of the chamber 10. The entire length of the chamber 10 may be actively heated, or the chamber 10 may have at least a trailing portion of the chamber 10 adjacent the outlet of the chamber that is not actively heated by heaters 12. The heating chamber 10 comprises a furnace, preferably a tunnel furnace that is several times longer than it is wide.

Figure 3:
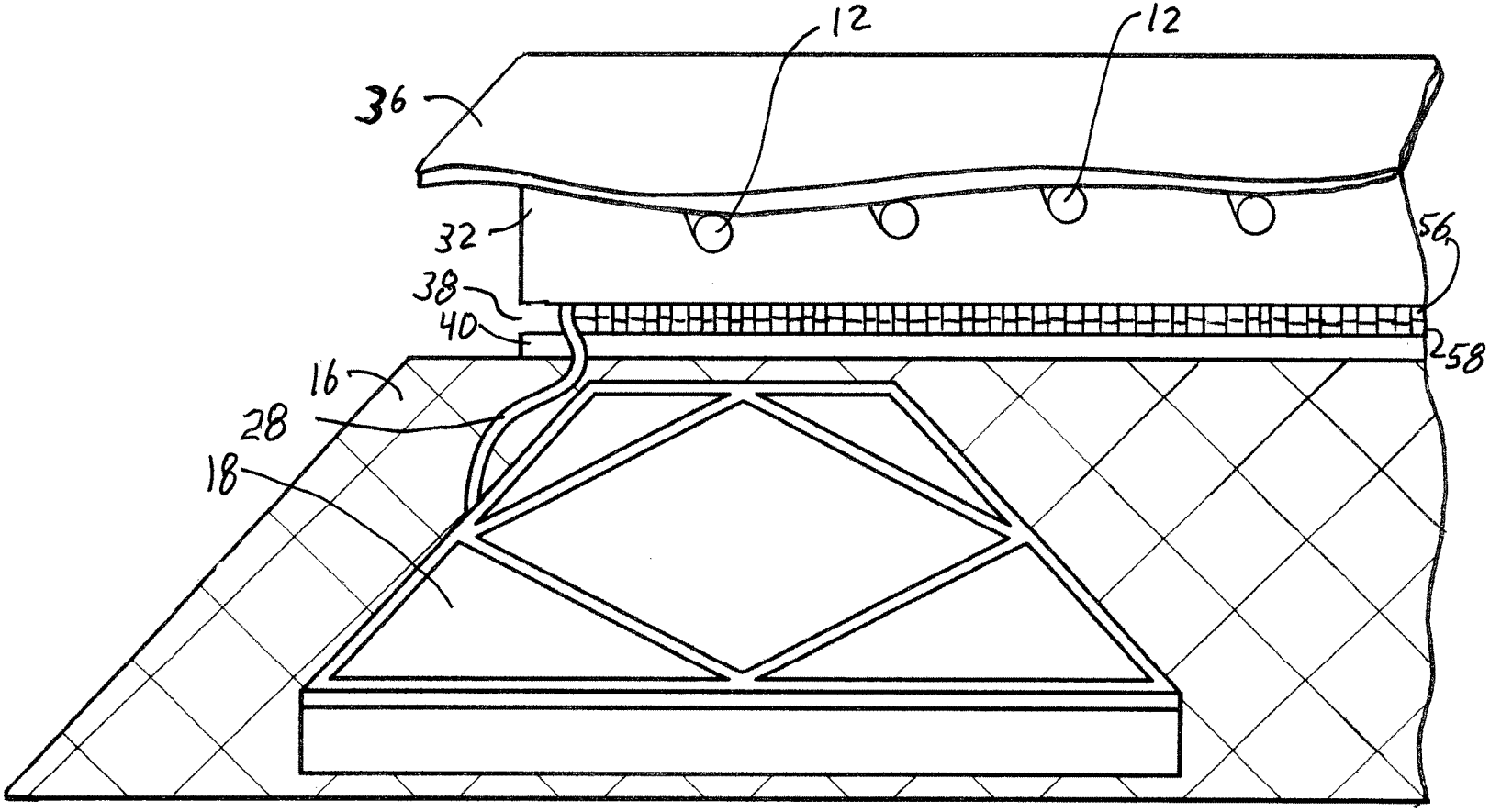
FIG. 3 is a partial perspective view of the tray of FIG. 1 on the conveying mechanism inside the heating chamber.

Referring to FIGS. 1 and 3, the slot 38 in the first sidewall 32 may be at the very bottom of the first sidewall 32 so the slot 38 forms a gap between the top surface of the conveyor belt 16 and the bottom edge of the sidewall 32. Alternatively, as shown in the drawings, a bottom portion of the first sidewall, referred to as bottom sidewall 40, may be spaced apart from the bottom of first sidewall 32 and close to the upper surface of first conveyor belt 16 when that conveyor belt surface forms the bottom of the chamber 10. In such cases, the conveyor belt 16 is preferably a metal mesh conveyor belt so as to reflect heat into and/or retain heat within the heating chamber 10. The bottom sidewall 40 is separated from the bottom edge of the first sidewall 32 by the slot 38, or separated from the top of the conveyor belt 16 by slot 38 when the sidewall 40 is not used. The bottom sidewall 40 is supported from below the sidewall 40, as for example, by a connection to the left of the conveyor belt 16 or a standoff extending from another part of the frame (not shown) which holds the heating chamber off the floor. The slot 38 has a vertical height "h" which is larger than a diameter "d" of the hose 28 or 28' at the location where the hose passes through and along the slot 38, but preferably, but preferably the height h of the slot 38 is less than twice the diameter of the hose passing through the slot in order to reduce heat loss from the furnace.

Figure 2A:
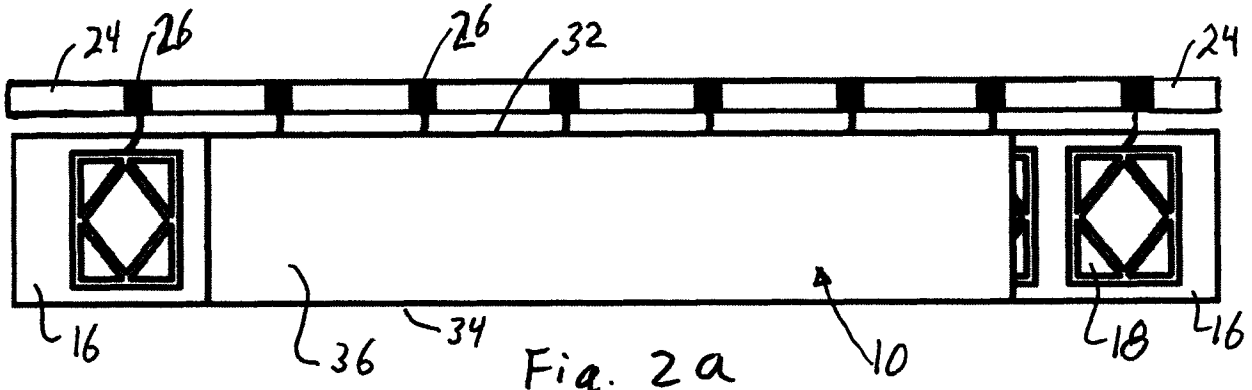
FIG. 2*a* is a top perspective view of an elongated heating chamber of FIG. 1 with a separation between the conveying mechanism and heating chamber.
Figure 2B:
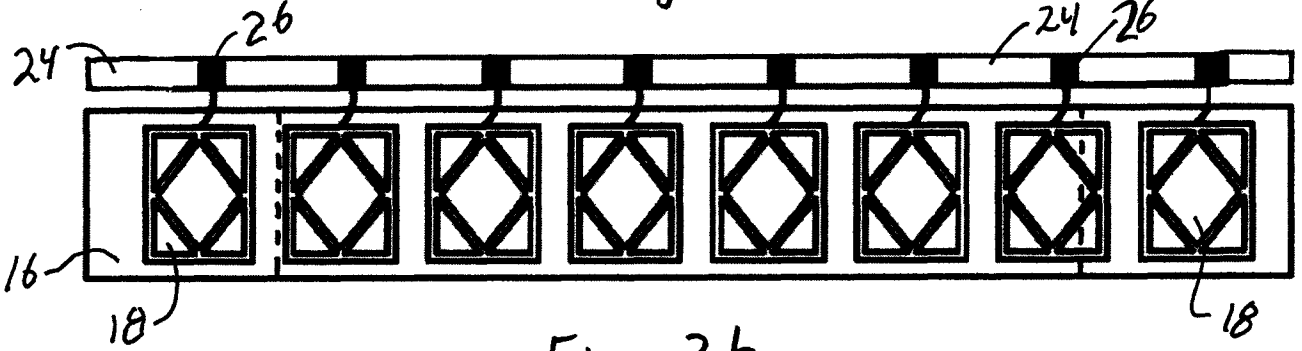
FIG. 2*b* is a cross-sectional view of the elongated heating chamber of FIG. 1 but not through the conveying mechanism, and shows the vacuum trays on the conveyor.

Referring to FIG. 1, the second conveyor belt 24 runs parallel to the first conveyor belt 16, and both the first and second conveyor belts 16, 24 preferably extend a short distance in front of and behind the heating chamber 10. The second conveyor belt 24 preferably, but optionally, is enclosed in an elongated housing sharing a portion of the first sidewall 32 as a common sidewall, so the slot 38 extends through that common sidewall 32. The housing for the second conveyor belt 24 has sidewall 42 opposite first (common) sidewall 32, and top wall 44 to form an inverted U-shaped housing with the second conveyor belt 24 as the bottom. The housing for the second conveyor belt 24 could be an entirely separate, elongated housing laterally offset from the first conveyor belt 16 as shown in FIGS. 2*a*, 2*b*, in which case a corresponding slot (not shown) to slot 38 must extend along the sidewall adjacent to the first sidewall 32 and first conveyor belt 16 a distance sufficient to keep the hoses 28, 28' from disconnecting from the vacuum tray until it is desired to disconnect it. The slot 32 extends through the sidewall 32 and preferably parallel to the first conveyor belt 16. The slot 32 could be formed by a gap between the bottom of the sidewall 32 and the first conveyor belt 16 and as used herein, the reference to a slot through the furnace sidewall encompasses a sidewall 32 with the described elongated slot 32 or the gap formed between the bottom edge of a sidewall 32 and the adjacent first conveyor belt 32.

Referring to FIG. 1, connected to the second belt 24 are a plurality of vacuum pumps 26, located a distance apart on the second belt to correspond with the planned spacing of vacuum trays 18. The second conveyor belt 24 may be an open mesh or link conveyor to make it easier to locate and affix the pumps 26 to the second conveyor belt. Advantageously, each pump may have a mounting plate bolted to the conveyor belt 24, with enough play in the bolts to allow the motion needed as the mounting plate and pump 26 passes around the curved portion of the second conveyor. Mounting bolts passing through the center of coil springs are believed to provide a sufficiently resilient mounting structure to allow motion as the conveyor belt 24 passes around the curved ends of the conveyor. The first and second conveyor belts 16, 24 may have drive rollers (or drive sprockets) 46 and return rollers (or return sprockets) 46 on a common shaft 48 (FIG. 1) in order to make synchronization easier. Thus, the first and second conveyor belts 16, 24 rotate about common axes 50 driven by a motor or motors that are not shown but known in the art. The conveyor belts 16, 24 are endless conveyor belts that travel in one direction through the furnace 10 and travel in an opposing direction on the return. The conveyor belts 16, 24 are shown as vertically arranged belts with the top belt generally horizontal as it is supported by rollers or guides, and with the return belt horizontal or sagging unsupported. But a single belt in a horizontal path that continually supports the belts 16, 24 could be used, including an oval path with straight sides and curved ends.

Still referring to FIG. 1, an electrical power rail 52 extends parallel to the second conveyor belt 24, preferably inside the inverted U-shaped housing formed by walls 42, 44 and 32. The power rail may be mounted off one or more of the walls 42, 44, 32. The power rail 52 contains an electrical power track extending along a length of the power rail and in electrical communication with an electrical power source (not shown) and preferably also has an electrically grounded track in electrical communication with an electrical ground, in order to provide electrical power and ground to vacuum pump 26 as it moves with the second conveyor belt 24 belt. Contacting wires 54 on vacuum pump 26 are resiliently biased in a direction to electrically engage the appropriate portion or electrical track of power rail 52 to make electrical contact and provide power to the vacuum pump when the wires 54 engage the appropriate track(s) on the power strip. In FIG. 1, the wires 54 are thus resiliently urged upward into electrical communication with the power rail 52 in order to provide electrical power to the vacuum pump 26, with the wires 54 bending as contact is made in order to resiliently urge the wires to maintain that electrical contact as the wires and pump move along the length of the power rail 52. The contacting wires 56 are shown as resilient metal wires located to engage the appropriate electrical track to activate the vacuum pump 26 when the pump is on the top of the second conveyor belt 24 and vacuum to hose 28 and tray 18 is needed, and to disengage and lose electrical communication when the pump 26 and wires 56 lose electrical contact with rail 52 as the tray 18 passes out of the heating chamber 10, and possibly earlier.

The length of the electrical power rail 52 may be shorter or longer than the length of the heating chamber 10 as the electrical contact with wires 54 a vacuum need not be maintained during the entire length of the heating chamber 10. Preferably though, the power rail 52 is located so the electrical contacts 54 provide power to the vacuum pump 26 to begin creating a negative pressure in the hose 28 and tray 18 before or upon entry into the heating chamber 10. Preferably, the power rail 52 ends so as to break electrical contact with wires 54 after the tray 18 has been in a heated portion of chamber 10 a time sufficient for tray 10 and products 22 to accept a sublimation image 20 and for that image to cool enough so it will not be distorted by removal of the pressure applied by the vacuum from pump 26 and hose 28. The power rail 52 and resiliently Referring to FIG. 3, the slot 38 may be open along a length of the slot. Preferably though, the slot is releasably closed by a high temperature, flexible insulating material that accommodates the movement of the hose 28 along the length of the slot while reducing heat loss from inside the furnace. The depicted closure comprises a first plurality of vertical strips 56 of flexible material such as silicon or rubber fastened to the outside of the sidewall 32 above the slot 38 and hanging or depending downward. A second plurality of such vertical strips 58 of the same flexible material extends upward to abut or overlap with the first plurality of strips 56 so as to close the slot 38 to outward passage of heated gas. As the hose 28 passes along the plurality of strips 56, 58, the hose displaces the individual strips of material sideways and after passing the strips of material resume their vertical or generally vertical orientation. A single, elongated piece of material may extend along the length of the slot and hang over the slot 38 or extend upward over the slot in order to close the slot 38 on opposing leading and trailing sides of the hose, but the flexibility of the material usually allows a gap to form adjacent the hose and hot gas may escape, so the single pieces. Thus, a plurality of strips of material is believed preferable. Individual strips of material in the plurality of strips 56, 58 comprising elongated bristles orientated vertically, or comprising a strip of material having a length parallel to the slot of 0.1 to one inch, made of silicon material, are believed suitable for a slot having a vertical height of about 0.4 inches. Advantageously, a lateral width of the material forming the individual strips of material is less than the diameter of the hose 28 passing through the slot 38 is believed suitable.

Figure 4:
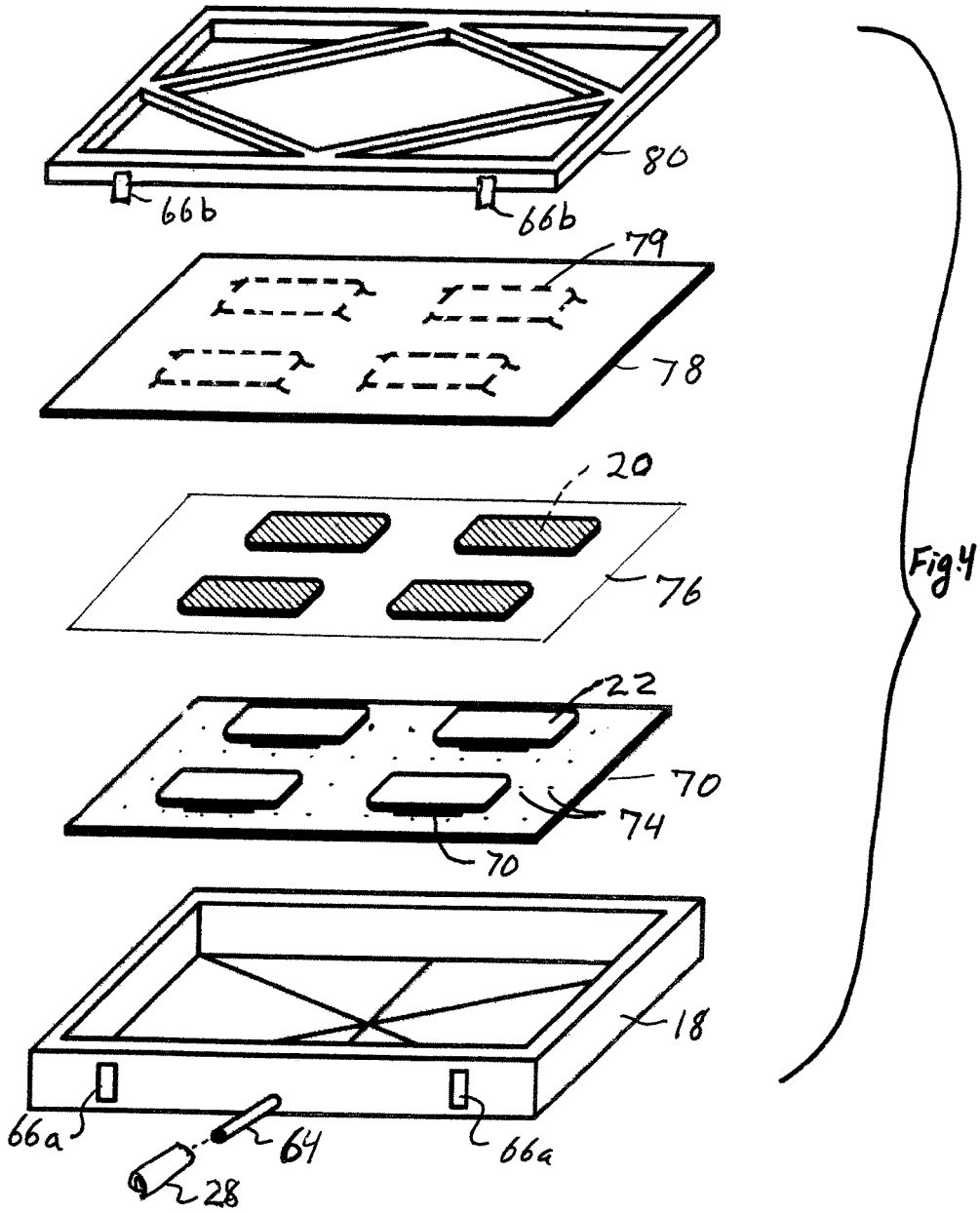
FIG. 4 is an exploded perspective view of the vacuum tray of FIG. 1.
Figure 5:
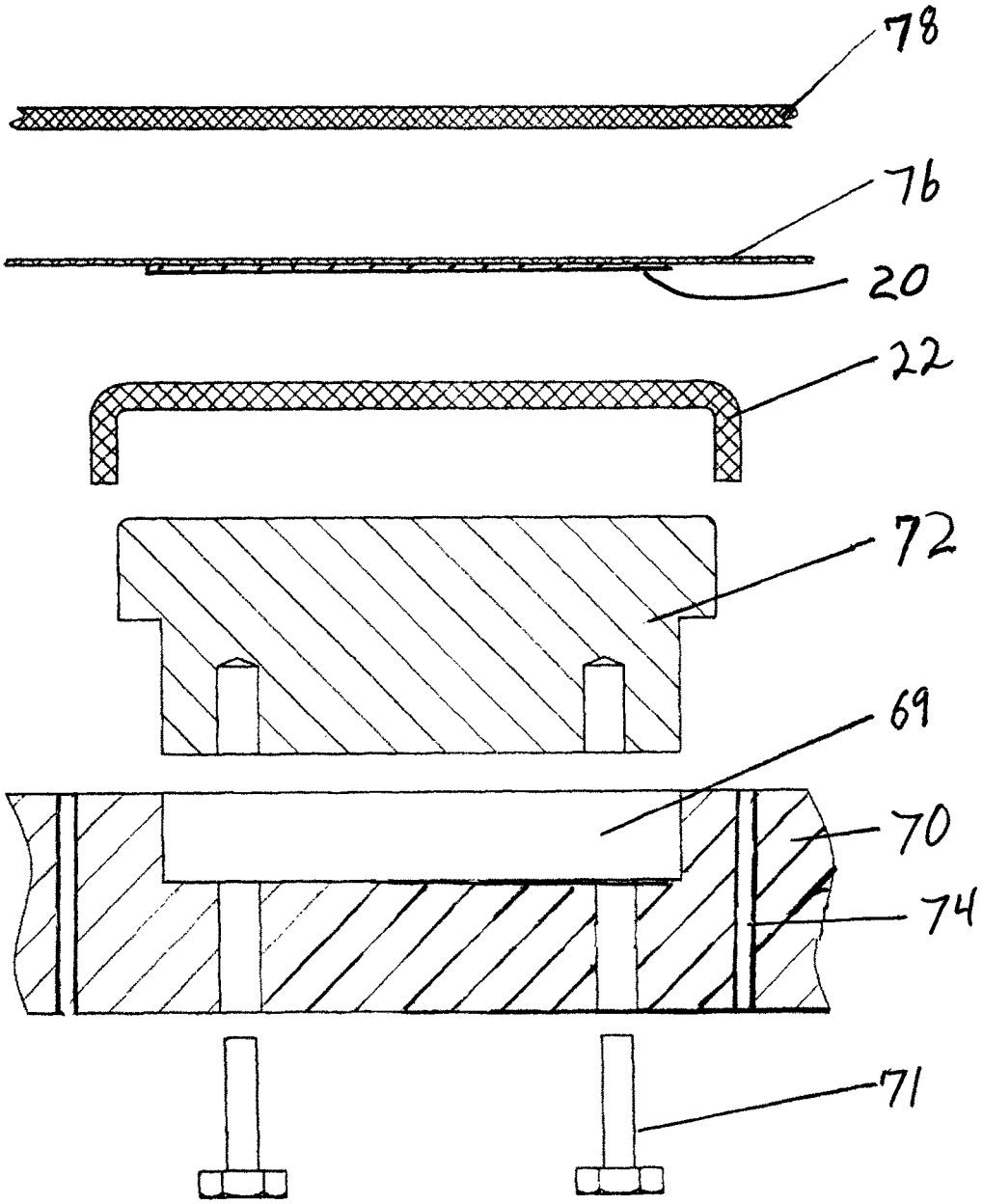
FIG. 5 is an exploded, partial perspective view of showing a portion of the tray of FIG. 1.

Referring to FIGS. 4-5, the vacuum tray 18 is shown as a rectangular tray with four sides and a bottom joined to form an air-tight portion of an enclosure. A hole is formed in one side of the tray 18 and a tube 64 may extend from that side a distance to connect to the vacuum hose 28. Typically the tube 64 comprises a male fitting that mates with the hose 28 as a female fitting, and mates in an air tight manner. The mated connection may be permanent or releasable. The tray 18 may optionally have first parts 66*a* of a latch mechanism.

For sublimation transfer, the tray 18 typically contains a support plate 70 that may have one or more shaped platens 72 configured to support parts or products 22 that are to receive the sublimation image 20. The support plate 70 may have recesses 69 configured to receive the platens 72, typically with bolts 71 passing through the plate 70 to securely fasten the platen to the plate 70 and allow air passage to the bottom of the platen. The support plate 70 typically conforms to the shape of the tray 18 and has a plurality of holes 74 through the plate to draw a vacuum.

The tray 18 typically has a bottom that is slightly concave or inclined to form a gap between the support plate 70 and the bottom of the tray to make it easier to withdraw all the air from the tray through tube 64. The tube 64 is preferably adjacent the bottom surface of the tray 18. The products 22 may have the dye transfer image applied directly to them by spray, screening, painting or other methods. FIG. 4 shows the sublimation dye transfer images 20 on a transfer sheet 76 with the sheet located relative to the support plate 70 and platens so the transfer images 20 align correctly with the products 22. A sealing sheet 78 is placed over the support 70 and transfer sheet 76. The sealing sheet is preferably larger than the transfer sheet. The sealing sheet 78 is typically a flexible sheet of thin silicon, rubber or other material impervious to air and suited to withstand the needed temperature. The sealing sheet may or may not have perforations 79 to facilitate deforming around a three-dimensional product. Finally, a frame 80, shaped to have a rigid or stiff periphery, shown in FIG. 4 as rectangular. The frame 80 preferably has second latch parts 66*b* located to mate with first latch parts 66*a*. The frame 80 forces the sealing sheet and transfer sheet against the support plate and forms a seal around a periphery of those parts so a vacuum from tube 38 evacuates the air between the sealing sheet 78 and the tray 18 within the periphery of the frame 80.

Referring to FIGS. 1-5, in use the sublimation image 20 is placed against the product 22 and placed on platen 72 on support sheet 70 in a tray 18. The image is applied directly to the part 22 or on a transfer sheet 76 placed over the part or product 22. The sealing sheet 78 is placed over the transfer sheet 76 (if present) and part 22, and frame 80 is placed over the sealing sheet 78 and fastened to the tray 18. The tray 18 has a vacuum hose 28 connected to a tray fitting 64 on the tray such as a tube 64 and that hose 28 is connected to a fitting on the vacuum pump 26 either directly or by connecting the hose 28 from the tray fitting 64 to a hose 28' connected to the fitting on the vacuum pump (FIG. 1). Various quick disconnect mechanisms may be used to connect the hose(s) 28, 28' to the respective parts, or a quick disconnect fitting 82 may be used to releasably connect the hoses 28, 28' to each other. The tray 18 is placed on the first conveyor belt 16 before or after the hose(s) 28, 28' are connected to the various parts using any fittings 82 as needed. The hose 28 (or 28') passes through the slot 38 as the tray 18 and connected vacuum pump move on their respective first and second conveyor belts 16, 24 as the tray is carried into the elongated heating chamber 18. The entrance to the slot 38 may be tapered (wider at the entrance) to direct the hose 28, 28' through the slot. The hose 38 is preferably long enough to allow flexibility in positioning of the tray 18 laterally on the belt 16 and along the length of the belt 16 during initial placement and during travel along the length of the conveyor. As used herein, the vacuum hose 28, 28' is a flexible, tubular hose made of rubber or other elastomers, with integrally formed stiffening ribs of the same material as the hose or of metal, as needed to withstand the vacuum and air pressure over the length of the hose. The hose 28, 28' could have stiff, metal or plastic tubular segments at the connections to the vacuum pump 26 or tray 18, and it is believed possible for the entire hose 28, 28' to be of such stiff metal or plastic material.

As the vacuum pump moves on the second conveyor belt 24, the electrical contacts 54 resiliently engage the power strip 52 to activate the pump and withdraw air from beneath the frame 80 and sealing sheet 78, causing the sheet 78 to press the image 20 against the product 22 at up to 14.7 pounds per square inch (psi.). The tray 18 and its contents are heated by heaters 12 (FIG. 3) to a temperature sufficient for sublimation transfer. The travel speed of conveyor belts 16, 24 and the length of the chamber 10 and the temperature of heaters 12 are selected to cause the image 20 to sublimate and transfer to the product 22. The vacuum should be maintained after the image 20 and product 22 immediately adjacent the image are cooled enough that the image and product will not distort when the clamping pressure exerted by the sealing sheet 78 and vacuum is released. This cooling is achieved by limiting the length of the heaters 12 along the length of the heating chamber 10, by stopping the length of the chamber 10 and having the conveyor belts 16, 24 extend beyond the walls 32, 34, 36 so ambient air cools the tray 18, or by actively cooling the tray 18 (e.g., blowing cool air) onto the trays, product and image after sublimation transfer occurs. The power rail (and preferably the enclosing walls 42, 44 and 32 preferably extend a length parallel to the second conveyor belt 24 sufficient to maintain the vacuum until the parts are cool enough to release the vacuum. The conveyor belts 16, 24 may continue after the power rail 52 stops and power to the vacuum pump 26 is disconnected. Before the conveyor belts 16, 24 curve to return to the entrance of the heating chamber and the beginning of the conveyor, the hose(s) 28, 28' (FIG. 1) are disconnected from one or more of the vacuum pump, tray or two parts of the hose (28, 28') via quick disconnect fitting 82 (FIG. 1), and the tray 18 (with the not imaged product 22) is removed from the conveyor belt 24 so the imaged product may be removed and new products and images placed into the tray for reuse. The vacuum pump preferably 26 remains connected to the second conveyor belt 24 and returns with that second conveyor belt 24 for reconnection to a new tray 18 via hose(s) 28, 28'.

Figure 6A:
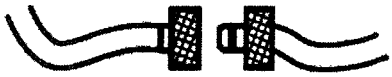
FIGS. 6*a*-6*c* are schematic illustrations of vacuum connections for the tray of FIG. 1.
Figure 6B:
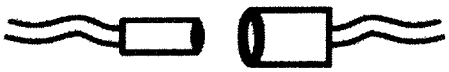
Figure 6C:
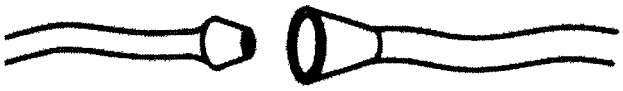

In some applications, a single hose 28 may be used to connect the vacuum pump 26 and tray 18, but it is preferred to have a hose 28, 28' on each of those parts with a quick disconnect fitting 82 to releasably connect the hoses. Any conventional quick-disconnect air hose fitting may be used for the fitting 82, and may couple the hoses, or couple either hose 28, 28' to the vacuum pump or tray associated with the specific hose and fitting being connected. Illustrative quick connections are shown in U.S. Pat. Nos. 4,193,616 and 9,377,145 and include various detent retention mechanisms, rotating interlocking mechanisms and snap fitting mechanisms. FIGS. 6*a*-6*c* schematically shows various mating configurations for the tubes of such disconnect fittings, with the quick release mechanism being varied as desired. The hose 28, 28' has tubing of sufficient wall thickness or reinforcing to withstand the vacuum applied to the tray.

The heating chamber 10 is preferably an elongated furnace similar to existing industrial mesh belt furnaces having an inlet end where trays 18 are placed on the conveyor belt 18 and an outlet end where the trays are removed from the belt after passing through the furnace. Such furnaces are believed available in various lengths and widths, with a width of first conveyor belt 18 of about 0.6 to 0.8 meters being believed suitable, and a length of about 9-12 meters believed suitable. The conveyor advantageously has a mesh belt transport chain, with suitable heaters 12 and fans (not shown) as desired to circulate heated air for uniform heating of the product 22 and images 20, and for blowing cooling air onto the trays, product and images once sublimation transfer is completed.

A separate vacuum pump 26 is preferably in fluid communication with a separate tray 18 and moves generally parallel with the tray, with second conveyor belt 24 supporting the vacuum pumps and first conveyor belt 16 supporting the vacuum trays. The evacuation of air from beneath the sealing sheet 78 allows atmospheric pressure to press the sheet 78 and transfer sheet 76 against the product 22 as the tray moves through the heating chamber 10 with the vacuum being maintained until sublimation transfer has occurred and preferably until the transferred image and the surface of the product 22 in which the image is embedded cool sufficiently so that the image does not distort, after which the vacuum may be released. A suitably flexible sealing sheet allows imaging of parts having various curved contours, including the curved surfaces joining the flatter sides and back of a case for a cell phone.

Referring to FIGS. 4-5, a sealing sheet, an image 20, either sprayed onto product 22 or on a contacting transfer sheet 76, and a workpiece 22 (such as a cup or mobile phone shell) may be placed in a suitably configured tray 18 having suitable supports 70 to hold the products during sublimation transfer, with a frame 80 to ensure the periphery of the sealing sheet 78 is pressed against the support plate 70 to allow air to be evacuated by vacuum pump 26 through hose 28, fitting 64 and holes 74 in the support 70. The tray and its contents are placed on the first conveyor belt 16 for movement through the heating chamber 10, and connected to the vacuum pump 26 associated with that tray, which pump also moves along with the tray but on second conveyor belt 24. Electrical contact of the vacuum pump wires 54 with the power strip 52 starts the vacuum pump to evacuate the air from tray 18 and allowing atmosphere pressure to press the sealing sheet 78 and image 20 against the product 22. Buy ending the power strip at a predetermined location along the length of the heating chamber 10, the vacuum may be released, resulting in a release of pressure on the image and product. Alternatively, the power strip 52 may have electrical power applied along varying lengths of the power strip, in order to start and stop electrical power to the vacuum pump 26 and thus start and stop the clamping force for sublimation transfer.

Referring to FIG. 1, the vacuum pumps 26 move along conveyor belt 24 through a chamber separate from heating chamber 10 but sharing a common sidewall 32 with the heating chamber 10, so the hose(s) 28, 28' move through a slit 38 in that common sidewall 32. As shown in FIGS. 2*a*, 2*b*, the vacuum pumps 26 and second conveyor belt 24 are preferably separated from and offset to one side of (but parallel to) the first conveyor 26, to allow air to insulate the pumps and second conveyor from the heating chamber 10.

The use of a separate vacuum pump 26 or each tray allows a smaller capacity pump to be used, reducing costs and, because the tray 18 allows a smaller area to be evacuated, allows faster application of the clamping force for sublimation once evacuation begins. The movement of the pump 26 simultaneous with the tray 18 allows the localized tray vacuum to be maintained as the tray moves along the length of the oven. The heat loss from the heating chamber may be reduced by providing insulating curtains arising from overlapping a plurality of strips 56, 58 of flexible but insulated and (suitably) temperature compatible material. Similar hanging strips of high temperature compatible, material hanging over the entrance and exit openings of the heating chamber 10 may be used to reduce heat loss through those openings. Similar hanging strips may be used internally to the heating chamber 10, as for example, to separate the heating portion of the conveyor belt 16 from a cooling portion of the chamber. While the reduction in heat loss through the slot 38 is shown as achieved by a "plurality" of separate strips 56, 58 hanging down and/or extending upward across some or all of the slot, a single strip of material could be used as long as it is flexible so as to allow the material to fold back over the slot in the area adjacent the hose 28, 28' passing through the slot and displacing the strip to allow passage of the hose. A strip sufficiently flexible to allow the strips 56, 58 to bend around the hose and extend across the slot within about 5-10 cm of the hose (measured along the length of the slot) is believed suitable.

There is also provided a method of sublimation coating a product 22 with a sublimation dye image 20, which preferably includes the step of placing the product and dye image 20 (on or off of a transfer sheet 76) in a first vacuum tray 18, preferably on a support plate 70, and covering the image, sheet and product with a sealing sheet 78. A frame 80 urges the sealing sheet 78 against the plate 70 to ensure evacuation of air between the sealing sheet and plate, allowing the atmosphere to press the sheet and image against the product 22. The method includes placing the tray on a first conveyor and removably placing the tray 18 and above described parts in fluid communication with a vacuum pump on a second conveyor moving along a length of the first conveyor. The connection with the tray is located to evacuate the space below the sealing sheet 78 and the vacuum tray 18, the support tray 70 having gas passages extending through it to allow such evacuation. The first and second conveyor belts carry the tray and parts into and through a heating chamber 10. The method includes applying electrical energy to the vacuum pump 26 and activating the pump to evacuate the tray and press the image against the product for sublimation transfer. The heating chamber is preferably selected so the conveyor speed, chamber temperature and chamber length are such as to heat the product 22 and image 20 high enough to achieve sublimation transfer of the image onto and preferably into a surface of the product. After sublimation transfer of the image 20 onto the product 22, the method preferably but optionally includes a step of passively or actively cooling the product, image and supply sheet to a temperature sufficient to prevent running of the dye forming the image 20, and preferably to prevent deformation of the product 20. After sublimation transfer of the image 20 onto the product 22, the power to the pump 26 may be disconnected to release the vacuum and pressure urging the image against the product. When the first conveyor belt 16 carries the first tray 18 and now imaged product 22 out of the heating chamber 10 the first tray is disconnected from the vacuum pump and removed from the first conveyor belt 16, while the vacuum pump continues to circulate with the second conveyor. The frame 80 is released (latches 66*a*, 66*b*) and the now imaged parts 22 removed from the first tray. While the first tray 18 is being moved by the first conveyor belt 16, a second tray 18 with second products 22 and second images 20 and second transfer sheet 78 are assembled and connected by second hoses 28, 28' to a second vacuum pump also connected to the second conveyor belt 24. Thus, a series of products, images, sealing sheets and trays are sequentially processed, allowing a continuous sequence of trays to be connected to dedicated vacuum pumps for evacuation and sublimation transfer of parts having various contours.

The method advantageously includes reducing heat loss by releasably blocking an elongated slot 38 extending along a length of the heating chamber as a connecting vacuum hose passes along the slot. The method preferably includes connecting at least one and preferably a plurality of strips 56, 58 of flexible, high temperature material to extend across part or the entire slot from one or both sides of the slot so as to block the passage of hot air through the slot. The method preferably includes moving the connecting vacuum hose along the slot with the hose pushing the at least one strip or strips of material aside to allow the hose to pass with the at least one strip or strips of material resiliently blocking the slot after passage of the hose. Preferably, the strips extend from opposing sides of the slot but each strip does not extend entirely across the slot so opposing strips cooperate to block the passage of hot gas out of the slot and past the strips. Advantageously, strips of such material hang downward from the top of the entrance and exit of the heating chamber, preferably extending to the first conveyor belt 16. The material forming strips 56, 58 is preferably suitable for use with sublimation temperatures, and may be silicon, rubber, or other suitable elastomers, or it may comprise small diameter bristles (like the bristles of a paint brush) of suitable material.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The above description is given by way of example, and not limitation. Given the above disclosure, one skilled in the art could devise variations that are within the scope and spirit of the invention, including various ways of Further, the various features of this invention can be used alone, or in varying combinations with each other and are not intended to be limited to the specific combination described herein. Thus, the invention is not to be limited by the illustrated embodiments. Finally, it should be noted that the above only to illustrate the utility of new technical solutions and are not limitations. Although the system and method are described in detail with reference to the preferred embodiments program, one of ordinary skill in the art should be understood that the present disclosure (for example in the form of kilns, molds and connection type relationship) may be modified or replaced by equivalents without departing from the spirit and scope of the disclosure and/or claims herein.

What is claimed is:

1. A furnace having a conveyor belt for heating a product on the belt as the product moves through the furnace on the belt, comprising:

a first endless conveyor belt extending along a first axis;

a furnace having a chamber extending above and along a first length of the first conveyor belt, the furnace chamber having an inlet end and an outlet end through which the first conveyor belt passes, the furnace having heaters and a first side wall extending along the first length of the first conveyor, the first side wall having a slot through the first side wall extending along the first conveyor;

a second endless conveyor belt extending along but offset from the first axis; and a plurality of vacuum pumps each connected to the second conveyor belt and moving with that second conveyor belt, each vacuum pump having a vacuum hose connected to it with the hose passing through the slot during use of the furnace and pump.

2. The furnace of claim 1, further comprising a power strip extending along a length of the second conveyor belt and having a first elongated electrically conductive strip carrying electrical current along that length of the second conveyor belt during use, each of the plurality of vacuum pumps having an electrical connection resiliently urged into electrical contact with that first conductive strip during use.

3. The furnace of claim 2, further comprising a vacuum housing extending along and enclosing the second conveyor belt and the power strip.

4. The furnace of claim 1, wherein the first and second conveyor belts are driven by a common drive shaft.

5. The furnace of claim 1, wherein the slot has a longitudinal length with two opposing sides and a vertical height between those two sides, and further comprising at least one flexible strip of material extending from one side of the slot toward the other side of the slot, the material having sufficient flexibility so each hose may push the material aside as the hose moves along the length of the slot.

6. The furnace of claim 5, wherein the flexible strip of material comprises first and second strips of material each extending from a different side of the slot and extending toward the other strip of material to block the slot.

7. The furnace of claim 1, further comprising a plurality of vacuum trays each in fluid communication with a different one of the vacuum pumps through the hose associated with each vacuum pump, each hose having a quick release coupling to releasably disconnect the hose from one of the vacuum pump or tray.

8. The furnace of claim 7, wherein the vacuum tray comprises an enclosure with a bottom and sidewalls, a perforated support plate, a mounting boss, a product on that boss, a sublimation transfer image abutting the product, a flexible sealing sheet overlapping the product and image and at least a portion of the support plate, and a frame configured to hold the sealing sheet against the support plate.

9. The furnace of claim 1, wherein the first and second conveyor belts are driven by a common drive shaft, and further comprising:

a power strip extending along a length of the second conveyor belt and having a first elongated electrically conductive strip carrying electrical current along that length of the second conveyor belt during use, each vacuum pump having a resilient electrical connection contacting the power strip and that first conductive strip during use; and a plurality of vacuum trays each in fluid communication with a different one of the vacuum pumps through the hose associated with that different one of the vacuum pumps, each hose having a quick release coupling to releasably connect the hose from one of the vacuum pump or tray.

10. A method for sublimation transfer using a vacuum tray having a sublimation transfer image and product which are located between a sealing sheet and a bottom of the tray, comprising the steps of:

placing a plurality of the vacuum trays on a first endless conveyor belt moving through a heated furnace, the furnace having an inlet end and an outlet end, each vacuum tray having a separate fluid connection located to evacuate air from between the sealing sheet and tray bottom, the tray placing step occurring at the inlet end of the furnace;

placing a separate vacuum pump in fluid communication with the separate fluid connection of a different one of the plurality of vacuum trays, each of the separate vacuum pumps being connected to and moving with a second endless conveyor belt moving parallel to the first conveyor belt;

evacuating air from between the sealing sheet and the tray bottom of each tray and pressing the sublimation transfer image against the product with sufficient force to achieve sublimation transfer;

heating the sublimation transfer image and product to a sublimation transfer temperature for a time sufficient to transfer the image to the product;

shutting off the vacuum pump and releasing the vacuum from the space between the sealing sheet and bottom of the tray; and removing the vacuum pump from fluid communication with the tray to which the vacuum pump was connected; and removing the tray from the first conveyor belt at the outlet end of the furnace.

11. The method of claim 10, wherein the step of evacuating air further includes activating each vacuum pump at a first predetermined location of the vacuum pump along a length of the second conveyor.

12. The method of claim 10, wherein the step of shutting off the vacuum pump includes shutting off each vacuum pump at a second predetermined location of the vacuum pump along a length of the second conveyor.

13. The method of claim 10, wherein the step of placing a separate vacuum pump in fluid communication with the separate fluid connection of a different one of the plurality of vacuum trays uses a hose for the fluid communication and includes passing that hose through a slot in the furnace and moving that hose along a length of the slot.

14. The method of claim 10, wherein the step of placing a separate vacuum pump in fluid communication with the separate fluid connection of a different one of the plurality of vacuum trays uses a hose with a quick disconnect coupling for the fluid communication.

15. The method of claim 10, wherein the step of removing the fluid connection between each of the plurality of trays and the vacuum pump to which the tray was connected includes disconnecting a hose from the vacuum pump from the different one of the plurality of vacuum trays using a quick disconnect coupling.

16. The method of claim 10, wherein the step of evacuating air from between the sealing sheet and the tray bottom of each tray comprises activating the vacuum pump when the tray is at a first predetermined location of the first conveyor belt relative to the furnace.

17. The method of claim 16, wherein the step of activating the vacuum pump includes placing the vacuum pump in electrical contact with a power strip extending along a length of the second conveyor belt to place the vacuum pump in electrical communication with a power source.

18. The method of claim 17, wherein the step of shutting off the vacuum pump includes disconnecting the vacuum pump from electrical contact with the power strip.

19. The method of claim 16, wherein the step of evacuating air from between the sealing sheet and the tray bottom of each tray comprises activating the vacuum pump before the tray has entered an actively heated portion of the furnace.

20. The method of claim 10, wherein the step of shutting off the vacuum pump comprises deactivating the vacuum pump when the tray is at a second predetermined location of the first conveyor belt relative to the furnace, with the second predetermined distance being closer to the outlet end of the furnace than the first second predetermined distance.

* * * * *